US005699639A

United States Patent [19]

Fernandez

[11] Patent Number: 5,699,639

[45] Date of Patent: Dec. 23, 1997

[54] ADJUSTABLE ANCHORAGE FOR TRUSSES

[76] Inventor: Roger Fernandez, 1010 E. 10 Ave., Hialeah, Fla. 33010

[21] Appl. No.: 537,041

[22] Filed: Dec. 14, 1995

[51] Int. Cl.[6] ..... E04B 1/41

[52] U.S. Cl. ..... 52/707; 52/92.2; 52/295; 52/698; 52/704

[58] Field of Search ..... 52/92.1, 92.2, 52/93.2, 295, 698, 699, 701, 703, 704, 706, 707, 708, 709, 710, 711, 713

[56] References Cited

U.S. PATENT DOCUMENTS

| | | | |
|---|---|---|---|
| 1,155,243 | 9/1915 | Jordahl | 52/707 X |
| 1,423,991 | 7/1922 | Brooks | 52/713 X |
| 2,013,101 | 9/1935 | Ingles | 52/713 X |
| 2,947,119 | 8/1960 | Puckett, Jr. | 52/699 |
| 3,000,145 | 9/1961 | Fine | 52/699 |
| 4,924,648 | 5/1990 | Gilb et al. | 52/295 |
| 5,307,603 | 5/1994 | Chiodo | 52/698 |
| 5,335,470 | 8/1994 | Alvarez | 52/92.2 X |
| 5,357,721 | 10/1994 | Alvarez . | |
| 5,442,887 | 8/1995 | Welsh | 52/92.2 |
| 5,467,569 | 11/1995 | Chiodo | 52/713 |
| 5,548,939 | 8/1996 | Carmical | 52/707 |

FOREIGN PATENT DOCUMENTS

| | | | |
|---|---|---|---|
| 2648039 | 4/1978 | Germany | 52/698 |
| 2832728 | 2/1980 | Germany | 52/713 |

*Primary Examiner*—Wynn E. Wood
*Assistant Examiner*—Laura A. Saladino

[57] ABSTRACT

An anchorage device for keeping a truss in place with respect to a poured concrete body having an elongated housing including a longitudinal slot and anchorage members rigidly mounted to the elongated housing thereby permitting the anchorage device being anchored in the poured cement. The anchorage device also having a connecting plate assembly with a strap including several openings for fastening a truss to the plate assembly. A lifted spacer area with two slots or cuts allows the strap through. The plate assembly is slidably mounted along the slot for its proper positioning after the truss are positioned.

5 Claims, 2 Drawing Sheets

ADJUSTABLE ANCHORAGE FOR TRUSSES

BACKGROUND OF THE INVENTION

1. Field of the Invention

The present invention relates to an adjustable anchorage for trusses.

2. Description of the Related Art

Applicant believes that the closest reference corresponds to U.S. Pat. No. 5,357,721 issued in 1994 to Gustavo O. Alvarez for "Adjustable Beam Holder". However, it differs from the present invention because the fastening mechanism is compatible with the use of a less expensive strap instead of clamp assembly of a predetermined size disclosed in Alvarez' patent. Also, and more important, inherent from the combination of the elements of the present invention results a device that can be mounted in considerably less time than the patented device.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that receives and adjusts itself to trusses having different dimensions.

It is another object of this invention to provide a device that is easy to install, store, transport and manipulate by a user.

It is still another object of the present invention to provide a device that gives trusses a sufficient strength to protect the building structure from strong winds.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
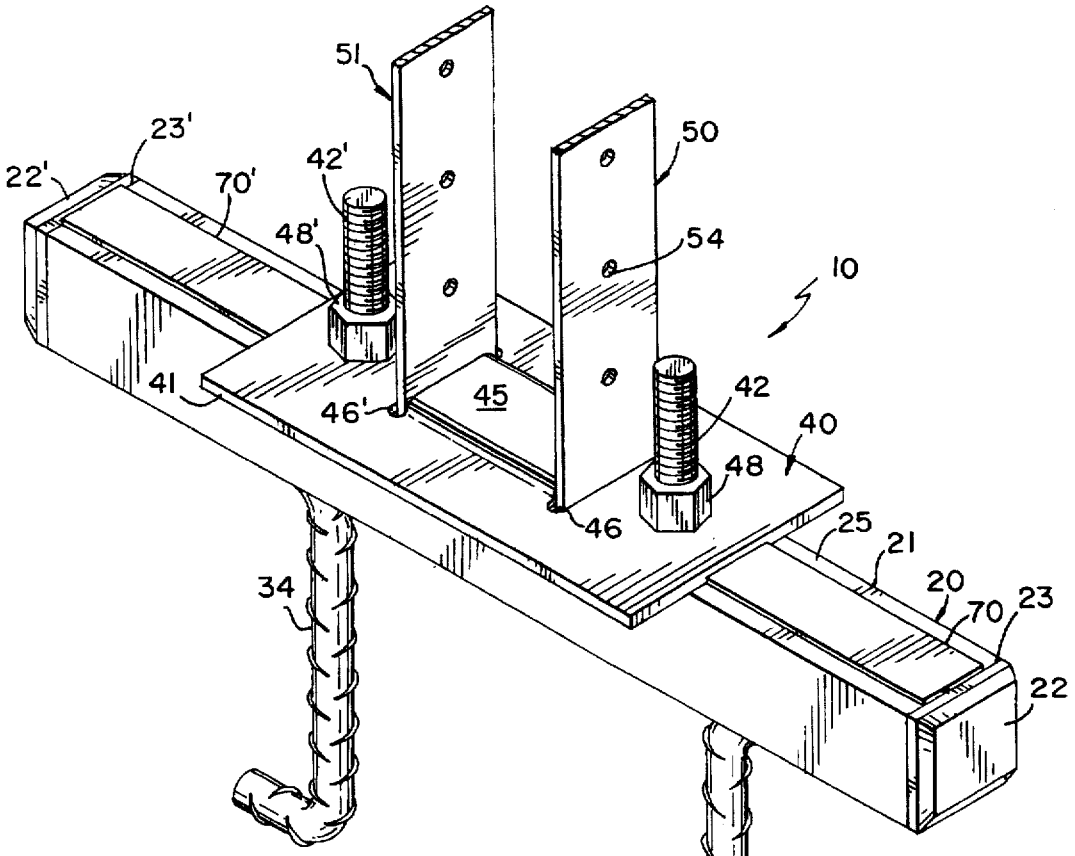
FIG. 1 represents an isometric view of the adjustable anchorage.

Referring now to the drawings, where the present invention is generally referred to with numeral 10, it can be observed that it basically includes anchorage assembly 20, connecting plate assembly 40 and fastening mechanism 50.

Figure 2:
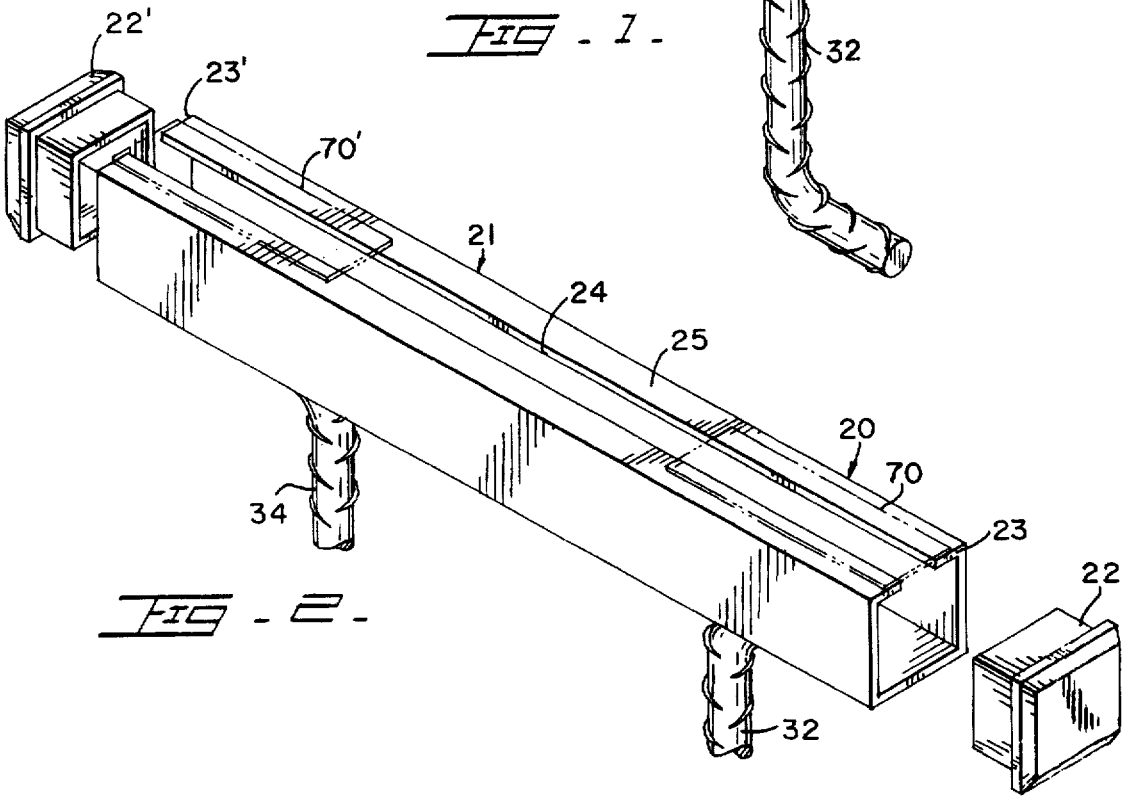
FIG. 2 shows a partial isometric exploded view of the anchorage assembly and cap members.

As shown in FIGS. 1 and 2, anchorage assembly 20 comprises elongated tubular housing 21 with longitudinal slot 24 at its uppermost wall 25 (as best seen in FIG. 2) and cap members 22 and 22' mounted at its ends 23 and 23', respectively. Seal members 70 and 70' are mounted covering slot 24, where it is not covered by connecting plate assembly 40, in order to protect the inner hollow space from any particles or residuals of concrete. In this manner, a user can slide connecting plate assembly 40 within elongated slot 24 to adjust assembly 40 to receive truss T. Housing 21 is placed in the poured concrete before it hardens, so that wall 25 is flush with the surface of the poured concrete. Anchorage assembly 20, also includes anchorage members 32 and 34 welded at the lowermost wall of tubular housing 21. Members 32 and 34 extend downwardly to provide a sufficient structural body that will be submerged inside the poured concrete, thereby providing the necessary anchorage function.

Plate assembly 40 includes plate member 41 which in turn includes slots 46 and 46' and spacer area 45. The upper curve of spacer area 45 is intended to provide a resting surface for trusses T preventing direct contact of the wood with the concrete. Suitable openings (not shown) are provided in plate member 41 to permit bolts 42 and 42Δ to go through.

Figure 5:
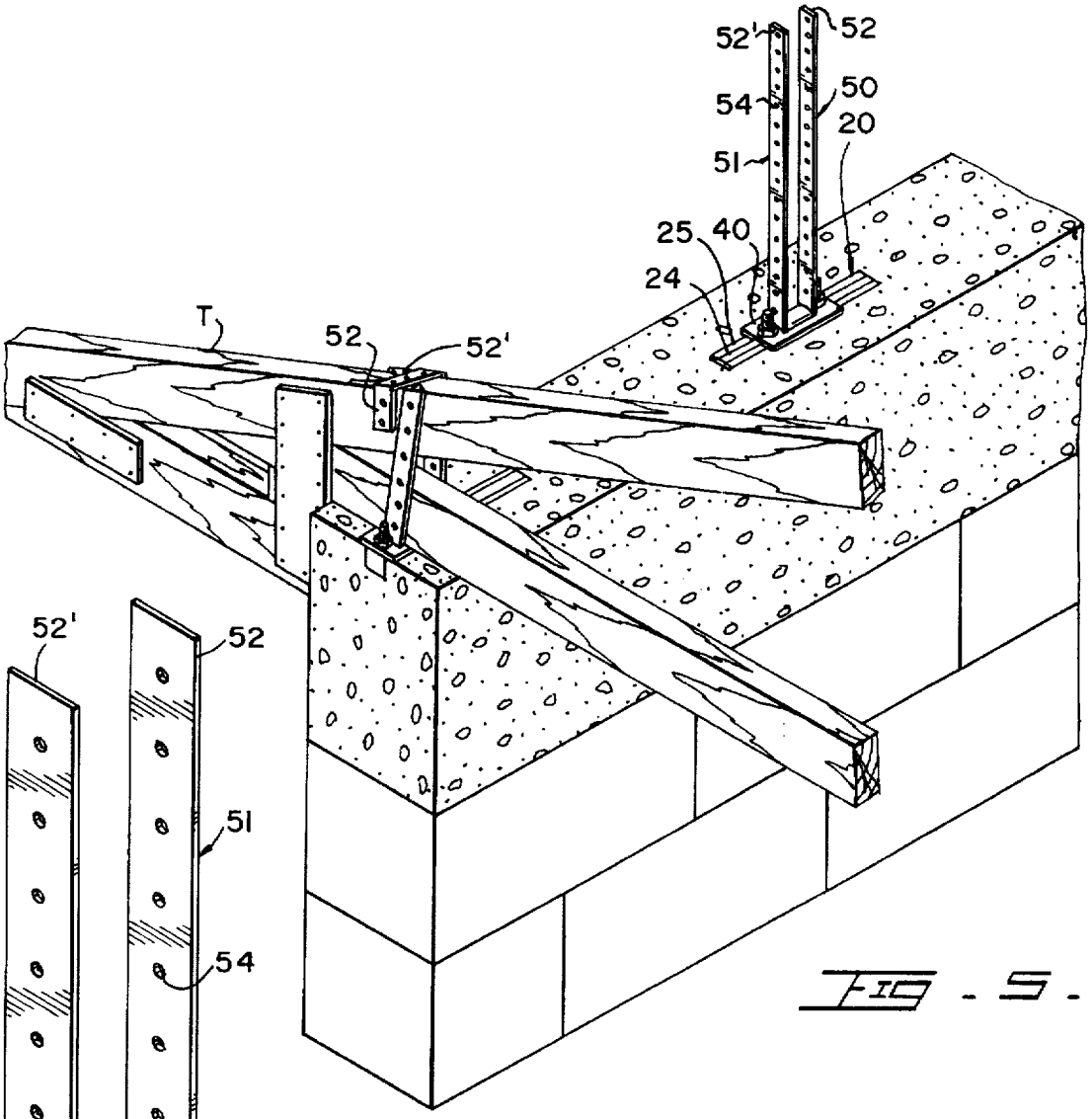
FIG. 5 illustrates an application of the present invention, before and after the trusses are mounted thereon.
Figure 3:
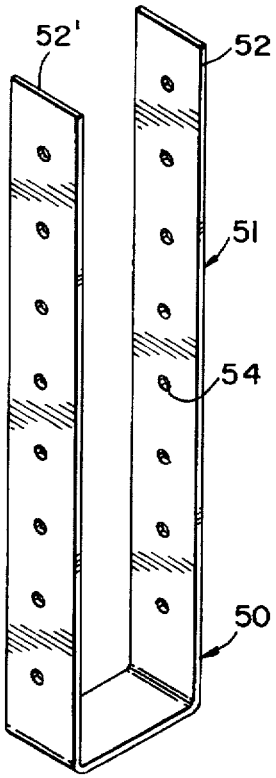
FIG. 3 illustrates an isometric view of the strap used in the present invention.
Figure 4:
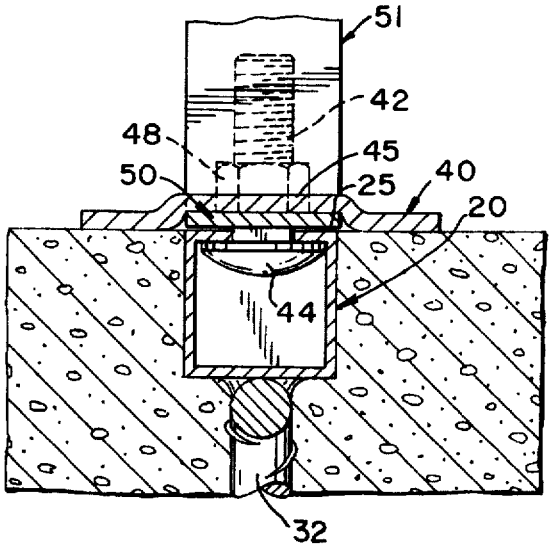
FIG. 4 is a partial cross sectional view of this invention anchored in a concrete tie beam.

The present invention uses, preferably for fastening assembly 50, conventional construction strap member 51 with openings 54 distributed along its length. Member 51, as seen in FIGS. 1; 3; 4 and 5, is passed through slots 46 and 46' of connecting plate member 41. Member 51 has strap ends 52 and 52'. Connecting plate member 41 includes openings through which adjusting bolts 42 and 42' pass. Adjusting bolts 42 and 42' have head 44 that permits connecting plate 40 to slide within slot 24 for trusses T to be adjusted. Connecting plate assembly 40 is slidably mounted and its position along housing 20 adjusted by nuts 48 and 48' for bolts 42 and 42', respectively. Strap member 51, as best illustrated in FIG. 3, is a strap bent in a U-shape and flexible end to embrace trusses T. Once trusses T are embraced by ends 52 and 52' nails are driven through openings 54, thereby providing the necessary security to the resulting structural body, as best seen in FIG. 5.

The foregoing description conveys the best understanding of the objectives and advantages of the present invention. Different embodiments may be made of the inventive concept of this invention. It is to be understood that all matter disclosed herein is to be interpreted merely as illustrative and not in a limiting sense.

What is claimed is:

1. An anchorage device for keeping a truss in place with respect to a poured concrete body, comprising:

a) elongated housing means including a longitudinal slot;

b) anchorage means mounted to said elongated housing means; and c) means for fastening said truss to said elongated housing means and said means for fastening said truss being slidably mounted to said elongated housing means along said slot including plate means having at least one fastening member for rigidly keeping said plate means at a predetermined position along said slot, and further including strap means for securing said truss mounted on said plate means.

2. The anchorage device set forth in claim 1 wherein said plate means includes spacer means for supporting said truss separated from said poured concrete body.

3. The anchorage device set forth in claim 2 wherein said elongated housing means includes two ends, and at least one of said ends is open, and further including a cap member for each of said open ends.

4. The anchorage device set forth in claim 3 further including protective means for sealing said slot to prevent said pour concrete from entering said housing.

5. The anchorage device set forth in claim 4 wherein said spacer means includes a raised portion of said plate means having first and second slots through which said strap means is passed.

* * * * *